US011320787B2

(12) United States Patent
Reymond

(10) Patent No.: US 11,320,787 B2
(45) Date of Patent: May 3, 2022

(54) RETROGRADE DISPLAY MECHANISM FOR HOROLOGY

(71) Applicant: HARRY WINSTON SA, Plan-les-Ouates (CH)

(72) Inventor: Cedric Reymond, Les Bioux (CH)

(73) Assignee: HARRY WINSTON SA, Plan-les-Ouates (CH)

( * ) Notice: Subject to any disclaimer, the term of this patent is extended or adjusted under 35 U.S.C. 154(b) by 527 days.

(21) Appl. No.: 16/299,185

(22) Filed: Mar. 12, 2019

(65) Prior Publication Data

US 2019/0286056 A1 Sep. 19, 2019

(30) Foreign Application Priority Data

Mar. 13, 2018 (EP) ..... 18161388.6

(51) Int. Cl.
*G04B 19/02* (2006.01)
*G04B 19/08* (2006.01)
(Continued)

(52) U.S. Cl.
CPC ..... *G04B 19/02* (2013.01); *G04B 19/082* (2013.01); *G04B 19/241* (2013.01); *G04B 19/25353* (2013.01); *G04B 19/268* (2013.01)

(58) Field of Classification Search
CPC ..... G04B 19/02; G04B 19/25353; G04B 19/082; G04B 19/241; G04B 19/268
See application file for complete search history.

(56) References Cited

U.S. PATENT DOCUMENTS 5,043,955 A * 8/1991 Dubois ..... G04B 45/00 368/228
7,625,116 B2 * 12/2009 Bron ..... G04B 19/082 368/101
(Continued)

FOREIGN PATENT DOCUMENTS

CH 701 836 B1 3/2011
EP 1 102 134 A1 5/2001
(Continued)

OTHER PUBLICATIONS

European Search Report dated Sep. 6, 2018 in European Application 18161388.6, filed on Mar. 13, 2018 (with English Translation of Categories of Cited Documents).

*Primary Examiner* — Sean Kayes
(74) *Attorney, Agent, or Firm* — Oblon, McClelland, Maier & Neustadt, L.L.P.

(57) ABSTRACT

A timepiece display mechanism including at least a first retrograde drive device for a first display member displaying a first magnitude, and a second retrograde drive device for a second display member displaying a second magnitude, the first retrograde drive device including a first drive rack to exert on a first wheel set driving the first display member, an opposite force to a resistance force exerted by a first return rack, the second retrograde drive device including a second drive rack to exert on a second wheel set driving the second display member, an opposite force to a resistance force exerted by a second return rack, wherein the pivot axes of the first drive rack and of the first return rack are remote, and/or the pivot axes of the second drive rack and of the second return rack are remote.

23 Claims, 2 Drawing Sheets

(51) Int. Cl.

| | |
|---|---|
| ***G04B 19/253*** | (2006.01) |
| ***G04B 19/24*** | (2006.01) |
| ***G04B 19/26*** | (2006.01) |

(56) References Cited

U.S. PATENT DOCUMENTS

| | | | | |
|---|---|---|---|---|
| 7,742,364 | B2 * | 6/2010 | Hiraga | G04B 19/082<br>368/80 |
| 9,398,299 | B2 * | 7/2016 | Gordon | H04N 19/44 |
| 2008/0106979 | A1 | 5/2008 | Bron et al. | |
| 2008/0253235 | A1 | 10/2008 | Hiraga et al. | |
| 2015/0301503 | A1 * | 10/2015 | Merdanovic | G04B 19/02<br>368/238 |
| 2017/0242400 | A1 * | 8/2017 | Denden | G04B 19/04 |
| 2019/0033788 | A1 * | 1/2019 | Denden | G04B 23/026 |
| 2020/0117142 | A1 * | 4/2020 | Denden | G04B 19/04 |

FOREIGN PATENT DOCUMENTS

| | | | | |
|---|---|---|---|---|
| EP | 1 918 792 | A1 | 5/2008 | |
| EP | 3112956 | A1 * | 1/2017 | G04B 19/087 |
| WO | WO 2006/052012 | A2 | 5/2006 | |

* cited by examiner

RETROGRADE DISPLAY MECHANISM FOR HOROLOGY

CROSS-REFERENCE TO RELATED APPLICATION

This application claims priority to European Patent Application No. 18161388.6 filed on Mar. 13, 2018, the entire disclosure of which is hereby incorporated herein by reference.

FIELD OF THE INVENTION

The invention concerns a timepiece display mechanism, including at least a first retrograde drive means for a first display member displaying a first magnitude, and a second retrograde drive means for a second display member displaying a second magnitude, said first retrograde drive means including a first drive rack arranged to exert, directly or indirectly, on a first wheel set driving said first display member, an opposite force to a resistance force exerted by a first return rack, and said second retrograde drive means including a second drive rack arranged to exert, directly or indirectly, on a second wheel set driving said second display member, an opposite force to a resistance force exerted by a second return rack.

The invention also concerns a timepiece movement including such a display mechanism.

The invention also concerns a timepiece, especially a watch, including such a timepiece movement, and/or such a display mechanism.

The invention concerns the field of retrograde display mechanisms for timepieces, in particular for watches.

BACKGROUND OF THE INVENTION

The retrograde display is a popular complication in horology which makes it possible to arrange on a dial a plurality of distinct displays, each of which remains clearly visible.

However, retrograde display mechanisms all occupy a large volume inside a watch case, and it is not always possible to accommodate them satisfactorily to offer the user a display with a logical juxtaposition of the various magnitudes displayed.

European Patent Application No EP1918792A1 in the name of LONGINES discloses a timepiece comprising a two-directional corrector mechanism for a device displaying a time-related magnitude, the display device being actuated by a control lever, in turn controlled by a cam on which the control lever rests. The timepiece includes a correction member actuated by a control stem which, in the display device correction phase, allows the control lever to be moved, via a return lever, away from the cam path on which the control lever normally rests in the normal operating mode of the timepiece.

SUMMARY OF THE INVENTION

The invention proposes to develop a combination of several retrograde displays, which is easily adaptable to the available volumes inside a watch case, and requires the smallest possible thickness, while relying on ordinary components of moderate cost.

To this end, the invention concerns a timepiece display mechanism including a first retrograde drive means for a first display member displaying a first magnitude, and a second retrograde drive means for a second display member displaying a second magnitude. The first retrograde drive means includes a first drive rack arranged to exert, directly or indirectly, on a first wheel set driving the first display member, an opposite force to a resistance force exerted by a first return rack. The second retrograde drive means includes a second drive rack arranged to exert, directly or indirectly, on a second wheel set driving said second display member, an opposite force to a resistance force exerted by a second return rack. The pivot axis of said first drive rack is remote from the pivot axis of the first return rack and/or the pivot axis of the second drive rack is remote from the pivot axis of the second return rack. The first retrograde drive means includes a first cam including a first ramp arranged to drive a first feeler arm comprised in the first drive rack in an operating stroke in a first drive direction of the first display member, and which includes, on the largest diameter of the first ramp, a threshold followed by a recess for uncoupling of the first drive rack arranged to allow the first feeler arm to return to the smallest diameter of the ramp with a return torque exerted indirectly on the first drive rack by the first return rack during an idle return stroke of said first return rack. The first retrograde drive means is arranged to drive the second retrograde drive means with a click carrying a drive finger arranged to drive an input wheel set comprised in the second retrograde drive means during the idle return travel.

The invention also concerns a timepiece movement including such a display mechanism.

The invention also concerns a timepiece, especially a watch, including such a timepiece movement, and/or such a display mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
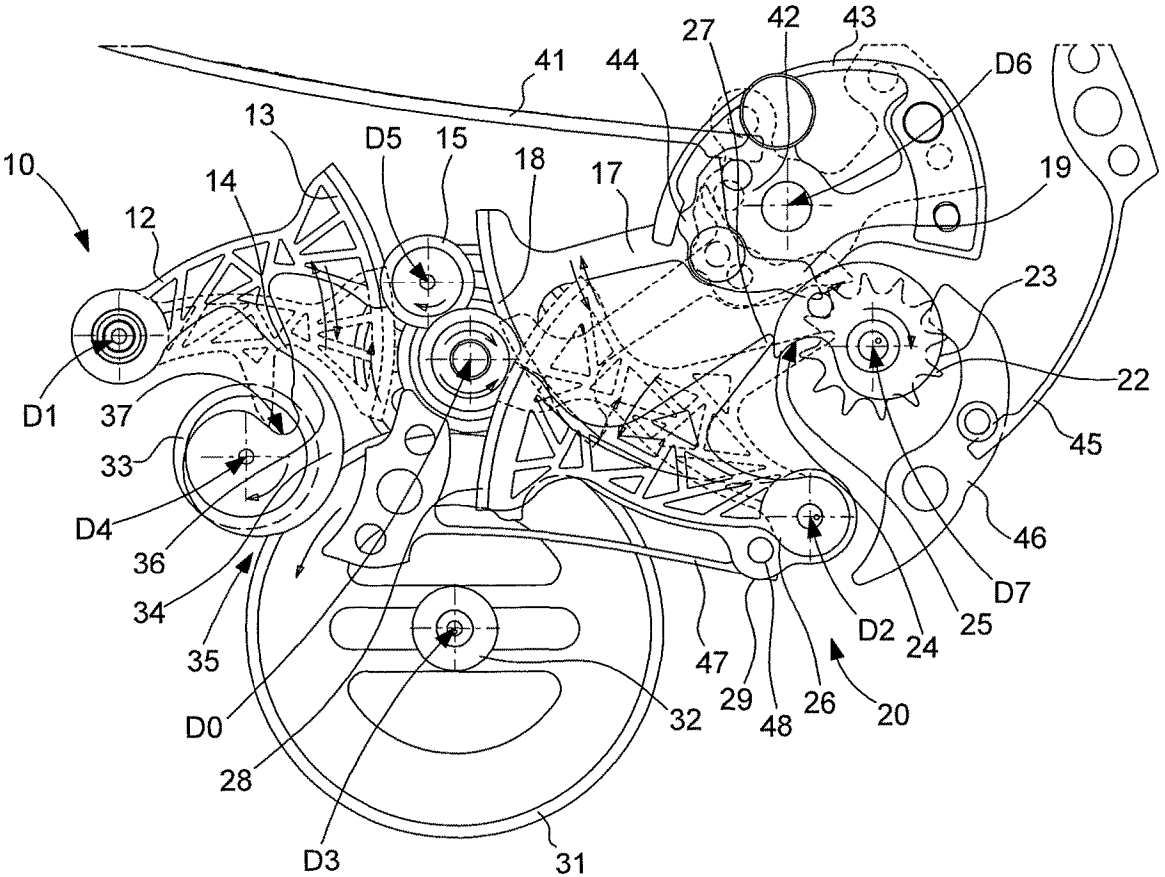
FIG. 1 represents a schematic, plan view of a retrograde display mechanism according to the invention, in a particular application to a first continuous-type retrograde mechanism displaying the minutes, and to a second jumping retrograde display of the hours.

The invention concerns a timepiece display mechanism 100 for a timepiece 1000, and more particularly for a watch.

This display mechanism 100 includes a least a first retrograde drive means 10 for a first display member 11 displaying a first magnitude, and a second retrograde drive means 20 for a second display member 21 displaying a second magnitude.

The invention is illustrated in the Figures for a non-limiting variant wherein the first magnitude is the minute and wherein the second magnitude is the hour.

First retrograde drive means 10 includes a first drive rack 12, which is arranged to exert, directly or indirectly, on a first wheel set 16 driving first display member 11, an opposite force to a resistance force exerted by a first return rack 17.

Second retrograde drive means 20 includes a second drive rack 26, which is arranged to exert, directly or indirectly, on a second wheel set 210 driving second display member 21, an opposite force to a resistance force exerted by a second return rack 29.

In particular and as seen in the Figures, first wheel set 16 and second wheel set 210 are coaxial along a pivot axis D0. More particularly still, first wheel set 16 and second wheel set 210 are coaxial with a cannon-pinion comprised in a timepiece movement 500, arranged to drive display mechanism 100, or in which display mechanism 100 is incorporated, along the same pivot axis D0.

According to the invention, the pivot axis of first drive rack 12 is remote from the pivot axis of first return rack 17 and/or the pivot axis of second drive rack 26 is remote from the pivot axis of second return rack 29.

In the variant illustrated by the Figures, pivot axis D1 of first minute drive rack 12 is remote from pivot axis D6 of first minute return rack 17 and the pivot axis of second hour drive rack 26 is coincident with pivot axis D2 of second hour return rack 29.

Figure 2:
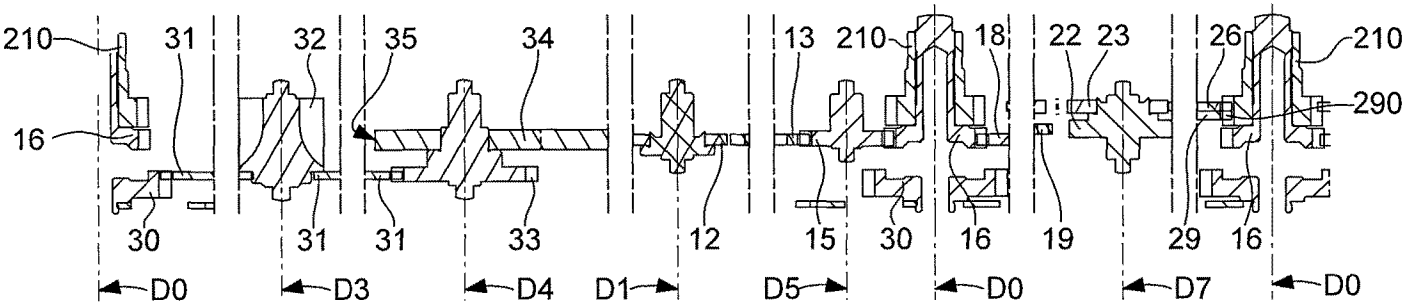
FIG. 2 represents the mechanism of FIG. 1, in a schematic partial cross-section in proximity to the various pivot axes of FIG. 1.
Figure 4:
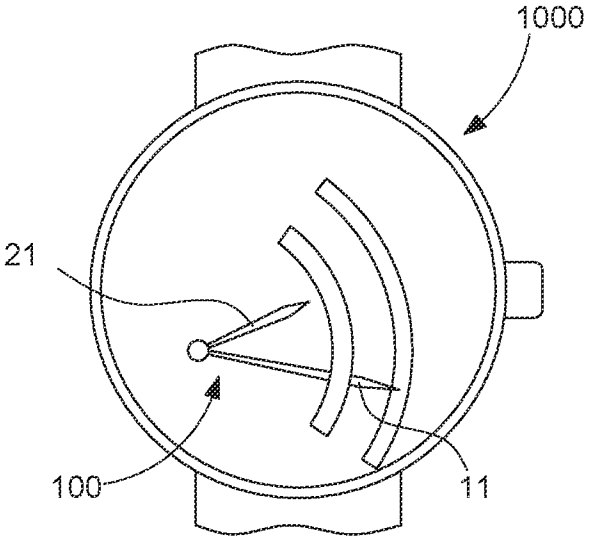
FIG. 4 represents a schematic, plan view of a second variant of a watch according to the invention.
Figure 5:
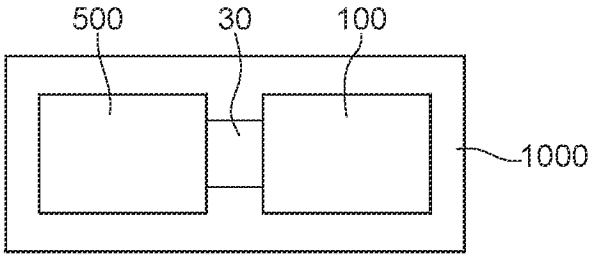
FIG. 5 is a block diagram showing a watch including such a timepiece movement driving such a display mechanism.

More particularly and as seen in FIGS. 1 and 2, first drive rack 12 is arranged to indirectly exert on first wheel set 16, via a first intermediate reverser 15 having a pivot axis D5 and meshing with first wheel set 16, an opposite force to a resistance force exerted directly on first wheel set 16 by first return rack 17.

In the variant illustrated by the Figures, second drive rack 26 is arranged to exert directly on second wheel set 210 driving second display member 21, an opposite force to a resistance force exerted by second return rack 29.

In another non-illustrated variant, first drive rack 12 is arranged to exert directly on first wheel set 16 an opposite force to a resistance force exerted indirectly on first wheel set 16, via a first, intermediate return reverser meshing with first wheel set 16, via first return rack 17.

In yet another non-illustrated variant, second drive rack 26 is arranged to exert indirectly on second wheel set 210, via a second, intermediate reverser meshing with second wheel set 210, an opposite force to a resistance force exerted directly on second wheel set 210 by second return rack 29.

In yet another non-illustrated variant, second drive rack 26 is arranged to exert directly on second wheel set 210 an opposite force to a resistance force exerted indirectly on second wheel set 210, via a second intermediate return reverser meshing with second wheel set 210, via second return rack 29.

In this illustrated variant, pivot axis D1 of first drive rack 12 is remote from pivot axis D6 of first return rack 17, and the pivot axis of first wheel set 16 is located between pivot axis D1 of first drive rack 12 and pivot axis D6 of first return rack 17.

More particularly still, first drive rack 12 is arranged to indirectly exert on first wheel set 16, via a first intermediate reverser 15 meshing with first wheel set 16, an opposite force to a resistance force exerted directly on first wheel set 16 by first return rack 17, and the pivot axis D5 of first intermediate reverser 15 is located between pivot axis D1 of first drive rack 12 and pivot axis D6 of first return rack 17.

In another non-illustrated variant, the pivot axis of second drive rack 26 is remote from the pivot axis of second return rack 29, and the pivot axis of second wheel set 210 is located between the pivot axis of second drive rack 26 and the pivot axis of second return rack 29.

In yet another non-illustrated variant, second drive rack 26 is arranged to exert indirectly on second wheel set 210, via a second, intermediate reverser meshing with second wheel set 210, an opposite force to a resistance force exerted directly on second wheel set 210 by second return rack 29, and the pivot axis of the second intermediate reverser is located between the pivot axis of second drive rack 26 and the pivot axis of second return rack 29.

More particularly, and in a non-limiting variant illustrated by the Figures, first retrograde drive means 10 is arranged to control a continuous-type retrograde movement of first display member 11, and second retrograde drive means 20 is arranged to control a jumping retrograde movement of second display member 12.

More particularly, first retrograde drive means 10 includes a first cam 34, that includes a first ramp 35, which is arranged to drive a first feeler arm 14 comprised in first drive rack 12 in an operating stroke in a first drive direction of first display member 11. Here, first feeler arm 14 is the end of an arm substantially perpendicular to the general direction in which first drive rack 12 extends, in the middle thereof.

This first cam 34 includes, on the largest diameter of first ramp 35, a threshold 36, which is followed by a recess 37 for uncoupling of first drive rack 12, and which is arranged to allow first feeler arm 14 to return to the smallest diameter of ramp 35 by means of a return torque exerted indirectly on first drive rack 12 by first return rack 17 during an idle return stroke of first return rack 17. In the variant of FIG. 1, first cam 23 is a snail cam.

In this variant of the Figures, first retrograde drive means 10 is arranged to drive second retrograde drive means 20 by means of a click. This click carries a drive finger 19, which is arranged to drive an input wheel set 22 having a pivot axis D7 and comprised in second retrograde drive means 20, during the idle return stroke.

More particularly, first cam 34 is driven from a drive wheel set 30, which is arranged to be driven by a movement 500, or comprised in a movement 500, and especially through a train. More particularly, the train includes at least one friction connection arranged to allow adjustment of the position of first display member 11. Naturally, a similar friction connection can be inserted elsewhere, in the drive train of first display member 11 and/or of second display member 21, or of any other display member comprised in display mechanism 100.

The train includes, in the variant of the Figures, from drive wheel set 30, a friction wheel 31 and a friction wheel set 32, wheel 31 meshes with a pinion 33 having a pivot axis D4, carrying first cam 34.

In particular, as seen in FIG. 1, first return rack 17 carries drive finger 19, which pivots and is subjected to torque from a return spring 43 fixed to first return rack 17, and which rests on a boss 44 or similar. This drive finger 19 is arranged to drive a star wheel comprised in input wheel set 22, and which is arranged to drive in rotation a second cam 23 comprised in second retrograde drive means 20.

More particularly, second cam 23 includes a second ramp, which is arranged to drive a second feeler arm 27, comprised in second drive rack 26, in an operating stroke in a first drive direction of second display member 12. Here, this second feeler arm 27 is the end of an arm tilted at around 60° with respect to the general direction in which second drive rack 26 extends, in the middle thereof.

This second cam 23 includes, on the largest diameter of the second ramp, a threshold 24, which is followed by a recess 25 for uncoupling of second drive rack 26, and which is arranged to allow second feeler arm 27 to return to the smallest diameter of ramp 35 by means of a return torque exerted indirectly on first drive rack 12 by first return rack 17 during an idle return stroke of first return rack 17.

In short, drive finger 19 is coupled to input wheel set 22 during the idle return stroke and uncoupled from input wheel set 22 during the operating stroke.

In a variant, as seen in FIG. 1, second cam 23 is a snail cam whose second ramp is smooth.

In another non-illustrated variant, the second ramp of second cam 23 is a stepped cam having a step for each unit of the second magnitude.

More particularly, first return rack 17 is permanently subjected to the return torque exerted by a first jumper spring 41, for example resting on a boss or a first pin 42; and second return rack 29 is more particularly permanently subjected to the return torque exerted by a second jumper spring 47, resting on a second pin 48 or similar.

In a non-illustrated variant, the pivot axis of first drive rack 12 is remote from the pivot axis of first return rack 17 and the pivot axis of second drive rack 26 is also remote from the pivot axis of second return rack 29.

The non-limiting illustrated variant concerns the case where first display member 11 is a minute display member, and second display member 21 is an hour display member.

In another non-illustrated variant, first display member 11 is an hour display member, and second display member 21 is an AM/PM or day/night or date display member.

In yet another non-illustrated variant, first display member 11 is an AM/PM or day/night or date display member, and second display member 21 is a month or lunar month display member.

In yet another non-illustrated variant, first display member 11 is a month or lunar month display member, and second display member 21 is a year display member.

More particularly, display mechanism 100 includes a date display, which includes an intermediate friction wheel, with a friction wheel 31 and a friction wheel set 32, along axis D3, and said intermediate friction wheel is incorporated in the train between drive wheel set 30 and first cam 34.

Figure 3:
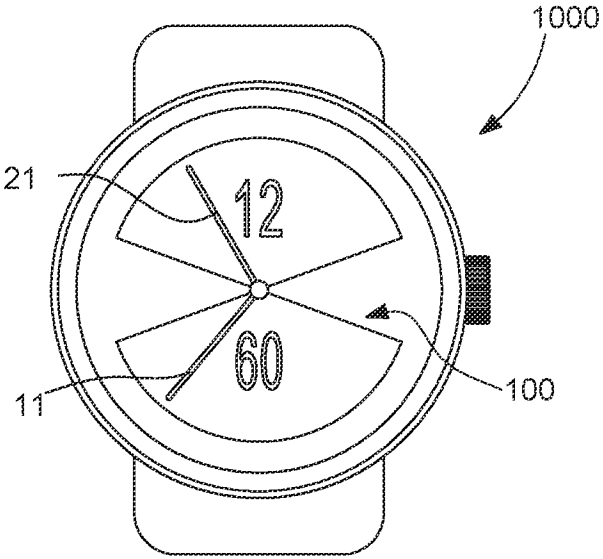
FIG. 3 represents a schematic, plan view of a first variant of a watch according to the invention.

In this particular example, information is taken from the cannon-pinion of the movement, the friction of the date wheel is used as intermediate wheel up to pinion 33 of the wheel set of first cam 34. This first cam 34 rotates through 360° and drives first feeler arm 14 of first drive rack 12 in a stroke here of around 25°. This angle, formed at the centre of the display on pivot axis D0 by toothing 13 of first drive rack 12, in combination with first intermediate wheel 15 and first wheel set 16, displays the minutes over an angular amplitude of 140°, as seen in FIG. 3. It is returned with first return rack 17, the minute display is thus continuous and retrograde.

First return rack 17 is armed with the driven minute wheel, its embedded click is released on retrograde hour star 22 as it is armed, without driving it. After a period of 60 minutes, the dropping of first return rack 17 drives its embedded click, whose drive finger 19 strikes star 22, and applies its rotation thereto. A jumper 46 combined with a jumper spring 45 holds star wheel 22 in position after its rotation. With each jump, star wheel 22, which has twelve teeth here, rotates through a twelfth of a turn. Second drive rack 26, coaxial with second return rack 29 along pivot axis D2, takes information from second cam 23, which pivots integrally with hour star 22, via its second feeler arm 27, and displays each hour precisely on a 140° display. The hour display is a jumping retrograde display.

The invention also concerns a timepiece movement 500 including at least one display mechanism 100 of this type. More particularly, this movement 500 includes an input wheel set 30, which is arranged to drive first retrograde drive means 10.

The invention also concerns a timepiece, in particular a watch 1000, including such a movement 500, and/or at least such a display mechanism 100. More particularly, timepiece movement 500 is arranged to drive an input wheel set 30 of display mechanism 100.

The invention claimed is:

1. A timepiece display mechanism comprising:

a first retrograde drive means for a first display member displaying a first magnitude; and a second retrograde drive means for a second display member displaying a second magnitude, said first retrograde drive means including a first drive rack arranged to exert, directly or indirectly, on a first wheel set driving said first display member, an opposite force to a resistance force exerted by a first return rack, said second retrograde drive means including a second drive rack arranged to exert, directly or indirectly, on a second wheel set driving said second display member, an opposite force to a resistance force exerted by a second return rack, wherein the first wheel set and the second wheel set are coaxial along a pivot axis, wherein at least one of a pivot axis of said first drive rack is remote from a pivot axis of said first return rack or a pivot axis of said second drive rack is remote from a pivot axis of said second return rack, wherein said first retrograde drive means includes a first cam including a first ramp arranged to drive a first feeler arm comprised in said first drive rack in an operating stroke in a first drive direction of said first display member, and which includes, on a largest diameter of said first ramp, a threshold followed by a recess for uncoupling of said first drive rack arranged to allow said first feeler arm to return to a smallest diameter of said first ramp with a return torque exerted indirectly on said first drive rack by said first return rack during an idle return stroke of said first return rack, and wherein said first retrograde drive means is arranged to drive said second retrograde drive means with a click carrying a drive finger arranged to drive an input wheel set comprised in said second retrograde drive means during said idle return stroke.

2. The timepiece display mechanism according to claim 1, wherein said first cam is driven from a drive wheel set arranged to be driven by a movement or comprised in a movement.

3. The timepiece display mechanism according to claim 2, wherein said first cam is driven from said drive wheel set via a train, which includes at least one friction connection arranged to allow adjustment of the position of said first display member.

4. The timepiece display mechanism according to claim 1, wherein said first return rack carries said drive finger which pivots and is subjected to the return torque of a return spring fixed to said first return rack, and said drive finger is arranged to drive a star comprised in said input wheel set and which is arranged to drive in rotation a second cam comprised in said second retrograde drive means.

5. The timepiece display mechanism according to claim 4, wherein said second cam includes a second ramp arranged to drive a second feeler arm comprised in said second drive rack in an operating stroke in a first drive direction of said second display member, and which includes, on a largest diameter of said second ramp, a threshold followed by a recess for uncoupling of said second drive rack arranged to allow said second feeler arm to return to the smallest diameter of said first ramp with a return torque exerted indirectly on said first drive rack by said first return rack during an idle return stroke of said first return rack, and wherein said first retrograde drive means is arranged to drive said second retrograde drive means with said drive finger, which is coupled to said input wheel set during said idle return stroke, and which is uncoupled from said input wheel set during said operating stroke.

6. The timepiece display mechanism according to claim 5, wherein said second cam is a snail cam and said second ramp is smooth.

7. The timepiece display mechanism according to claim 5, wherein said second ramp of said second cam is a stepped cam including a step for each unit of said second magnitude.

8. The timepiece display mechanism according to claim 1, wherein said first drive rack is arranged to indirectly exert on said first wheel set, via a first intermediate reverser meshing with said first wheel set, an opposite force to a resistance force exerted directly on said first wheel set by said first return rack, or wherein said first drive rack is arranged to exert directly on said first wheel set an opposite force to a resistance force exerted indirectly on said first wheel set, via a first, intermediate return reverser meshing with said first wheel set, via said first return rack.

9. The timepiece display mechanism according to claim 1, wherein said second drive rack is arranged to exert indirectly on said second wheel set, via a second intermediate reverser meshing with said second wheel set, an opposite force to a resistance force exerted directly on said second wheel set by said second return rack, or wherein said second drive rack is arranged to exert directly on said second wheel set an opposite force to a resistance force exerted indirectly on said second wheel set, via a second intermediate return reverser meshing with said second wheel set, via said second return rack.

10. The timepiece display mechanism according to claim 1, wherein said pivot axis of said first drive rack is remote from the pivot axis of said first return rack, and wherein the pivot axis of said first wheel set is located between the pivot axis of said first drive rack and the pivot axis of said first return rack.

11. The timepiece display mechanism according to claim 10, wherein said first drive rack is arranged to exert indirectly on said first wheel set, via a first intermediate reverser meshing with said first wheel set, an opposite force to a resistance force exerted directly on said first wheel set by said first return rack, and wherein the pivot axis of said first intermediate reverser is located between the pivot axis of said first drive rack and the pivot axis of said first return rack.

12. The timepiece display mechanism according to claim 1, wherein the pivot axis of said second drive rack is remote from the pivot axis of said second return rack, and wherein the pivot axis of said second wheel set is located between the pivot axis of said second drive rack and the pivot axis of said second return rack.

13. The timepiece display mechanism according to claim 12, wherein said second drive rack is arranged to exert indirectly on said second wheel set, via a second intermediate reverser meshing with said second wheel set, an opposite force to a resistance force exerted directly on said second wheel set by said second return rack, and wherein the pivot axis of said second intermediate reverser is located between the pivot axis of said second drive rack and the pivot axis of said second return rack.

14. The timepiece display mechanism according to claim 1, wherein said first retrograde drive means is arranged to control a continuous-type retrograde movement of said first display member, and wherein said second retrograde drive means is arranged to control a jumping retrograde movement of said second display member.

15. The timepiece display mechanism according to claim 1, wherein said first return rack is permanently subjected to the return torque exerted by a first jumper spring, and wherein said second return rack is permanently subjected to the return torque exerted by a second jumper spring.

16. The timepiece display mechanism according to claim 1, wherein the pivot axis of said first drive rack is remote from the pivot axis of said first return rack and the pivot axis of said second drive rack is also remote from the pivot axis of said second return rack.

17. The timepiece display mechanism according to claim 1, wherein said first display member is a minute display member and said second display member is an hour display member.

18. The timepiece display mechanism according to claim 1, wherein said first display member is an hour display member, and said second display member is an AM/PM or day/night or date display member.

19. The timepiece display mechanism according to claim 1, wherein said first display member is an AM/PM or day/night or date display member, and said second display member is a month or lunar month display member.

20. The timepiece display mechanism according to claim 1, wherein said first display member is a month or lunar month display member, and said second display member is a year display member.

21. The timepiece display mechanism according to claim 3, wherein said display mechanism includes a date display including an intermediate friction wheel which is incorporated in said train between said drive wheel set and said first cam.

22. The timepiece movement comprising at least one timepiece display mechanism according to claim 1 and including an input wheel set arranged to drive said first retrograde display means.

23. A watch comprising a movement according to claim 22, and at least one pf display mechanism and a timepiece movement arranged to drive an input wheel set of said display mechanism.

* * * * *